US010573975B2

(12) United States Patent
Yi et al.

(10) Patent No.: US 10,573,975 B2
(45) Date of Patent: Feb. 25, 2020

(54) METHOD OF MAKING A CONFORMAL ARRAY ANTENNA

(71) Applicant: TAIWAN GREEN POINT ENTERPRISES CO., LTD., Taichung (TW)

(72) Inventors: Sheng-Hung Yi, Taichung (TW); Pen-Yi Liao, Taichung (TW); Tsung-Han Wu, Taichung (TW); Po-Cheng Huang, Taichung (TW)

(73) Assignee: Taiwan Green Point Enterprises Co., Ltd., Taichung (TW)

( * ) Notice: Subject to any disclaimer, the term of this patent is extended or adjusted under 35 U.S.C. 154(b) by 89 days.

(21) Appl. No.: 15/866,907

(22) Filed: Jan. 10, 2018

(65) Prior Publication Data

US 2019/0214742 A1 Jul. 11, 2019

(51) Int. Cl.

| | |
|---|---|
| ***H01Q 21/20*** | (2006.01) |
| ***H01Q 1/12*** | (2006.01) |
| ***H01Q 1/52*** | (2006.01) |
| ***H01Q 1/38*** | (2006.01) |
| ***H01Q 21/00*** | (2006.01) |
| ***H01Q 9/42*** | (2006.01) |

(52) U.S. Cl.

CPC ..... *H01Q 21/205* (2013.01); *H01Q 1/12* (2013.01); *H01Q 1/38* (2013.01); *H01Q 1/528* (2013.01); *H01Q 9/42* (2013.01); *H01Q 21/0087* (2013.01)

(58) Field of Classification Search

CPC ..... H01Q 1/12; H01Q 1/38; H01Q 1/528; H01Q 21/205

See application file for complete search history.

(56) References Cited

U.S. PATENT DOCUMENTS

| | | | | |
|---|---|---|---|---|
| 9,159,018 | B2 * | 10/2015 | Coleman | G06K 19/07718 |
| 9,629,267 | B2 * | 4/2017 | Asrani | B32B 15/08 |
| 2019/0214742 | A1 * | 7/2019 | Yi | H01Q 1/12 |

FOREIGN PATENT DOCUMENTS

JP 2004193937 A 7/2004

* cited by examiner

*Primary Examiner* — Minh N Trinh

(74) *Attorney, Agent, or Firm* — Young Basile Hanlon & MacFarlane, P.C.

(57) ABSTRACT

A method for making a conformal array antenna includes: providing a substrate having a non-conductive curved surface; roughening the curved surface; forming an activation layer containing an active metal on the roughened curved surface; forming a first metal layer on the activation layer by chemical plating process; and defining a plurality of spaced-apart antenna pattern regions on the first metal layer, by forming a gap along an outer periphery of each of the antenna pattern regions to isolate the antenna pattern regions from a remainder of the first metal layer. The curved surface is roughened by blasting a plurality of particles thereonto, or the spaced-apart antenna pattern regions are substantially evenly distributed.

14 Claims, 13 Drawing Sheets

METHOD OF MAKING A CONFORMAL ARRAY ANTENNA

FIELD OF INVENTION

The disclosure relates to a method of making an antenna, and more particularly to a method of manufacturing a conformal array antenna, and to the conformal array antenna made therefrom.

BACKGROUND

A conventional method of forming a patterned conductive circuit on a radar antenna, as disclosed in Japanese Patent Application Publication No. 2004-193937A, includes the steps of forming a conductive copper layer on a concave surface of a plastic substrate by chemical plating process, thickening the conductive copper layer by electroplating process, forming an antenna pattern region by laser ablation to remove the conductive copper layer outside of the antenna pattern region, and forming a protective nickel layer on the antenna pattern region of the thickened copper layer by electroplating process. Even though the above-mentioned method can be applied to form patterned conductive circuit on a non-conductive substrate, operating time of a laser ablation machine for removing the conductive copper layer outside of the antenna pattern region may be long, especially for a substrate that is relatively large in size. Long operating time of the laser ablation machine undesirably increases the manufacturing time and the manufacturing cost of the radar antenna.

SUMMARY

According to one aspect of the disclosure, a method of making a conformal array antenna includes providing a substrate having a non-conductive curved surface; blasting a plurality of particles onto the curved surface of the substrate to roughen the curved surface, forming an activation layer containing an active metal on the roughened curved surface, forming a first metal layer on the activation layer by chemical plating process, and defining a plurality of spaced-apart antenna pattern regions on the first metal layer, by forming a gap along an outer periphery of each of the antenna pattern regions to isolate the antenna pattern regions from a remainder of the first metal layer.

According to another aspect of the disclosure, the conformal array antenna includes a substrate and a conductive circuit.

The substrate has a non-conductive roughened curved surface formed with a plurality of hook-shaped structures that are formed by blasting a plurality of particles on the substrate. The non-conductive roughened curved surface defines a plurality of spaced-apart antenna pattern regions. The conductive circuit is located in the antenna pattern regions, and includes an activation layer formed on the roughened curved surface and containing an active metal, and a first metal layer formed on the activation layer.

According to still another aspect of the disclosure, a method of making the conformal array antenna includes providing a substrate having a non-conductive curved surface, roughening the curved surface; forming an activation layer containing an active metal on the non-conductive roughened curved surface, forming a first metal layer on the activation layer by chemical plating process, and defining a plurality of spaced-apart and substantially evenly distributed antenna pattern regions on the first metal layer, by forming a gap along an outer periphery of each of the antenna pattern regions to isolate the antenna pattern regions from a remainder of the first metal layer.

BRIEF DESCRIPTION OF THE DRAWING(S)

Other features and advantages of the disclosure will become apparent in the following detailed description of the embodiment(s) with reference to the accompanying drawings, of which:

DETAILED DESCRIPTION

Figure 1:
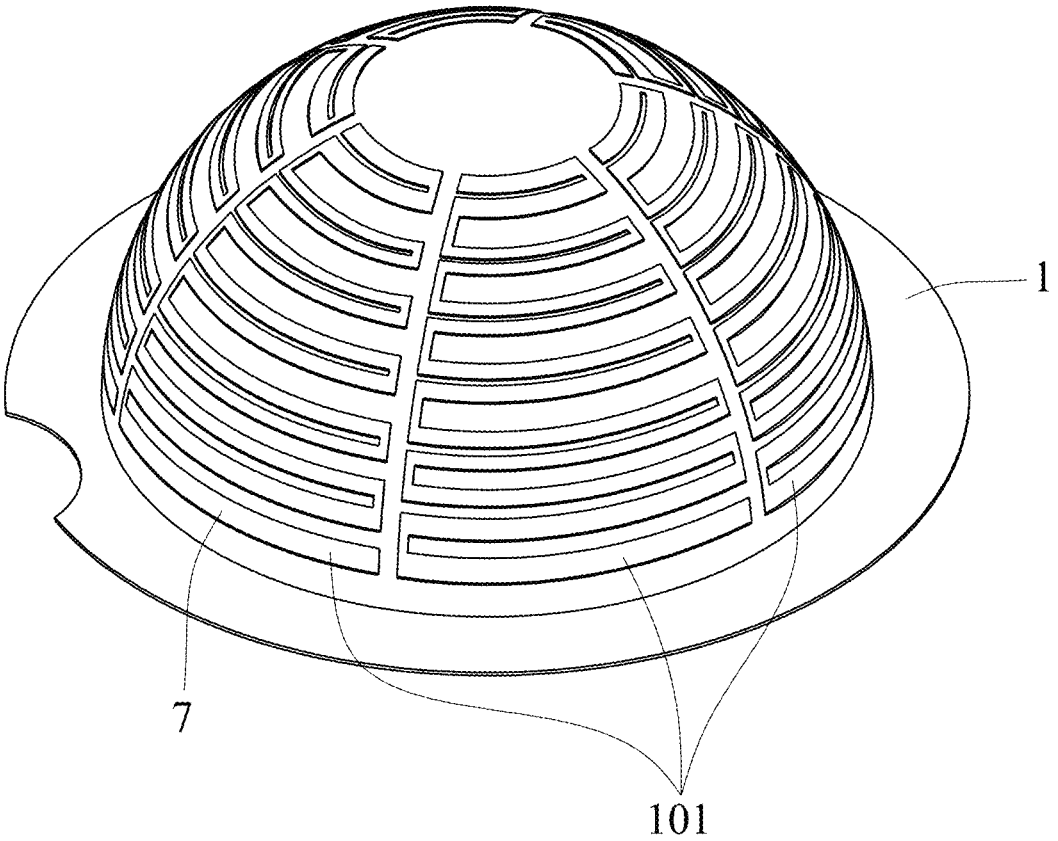
FIG. 1 is a perspective view illustrating an embodiment of a conformal array antenna according to the disclosure.

FIG. 1 is an embodiment of a conformal array antenna according to the disclosure, which includes a substrate 1 defined with a plurality of spaced-apart antenna pattern regions 101 that are substantially evenly distributed, and a conductive circuit 7 formed on the spaced-apart antenna pattern regions 101. The antenna pattern regions 101 may be identical or similar in pattern. In certain embodiments, the antenna pattern regions 101 are spaced apart from each other by a fixed distance.

Figure 2:
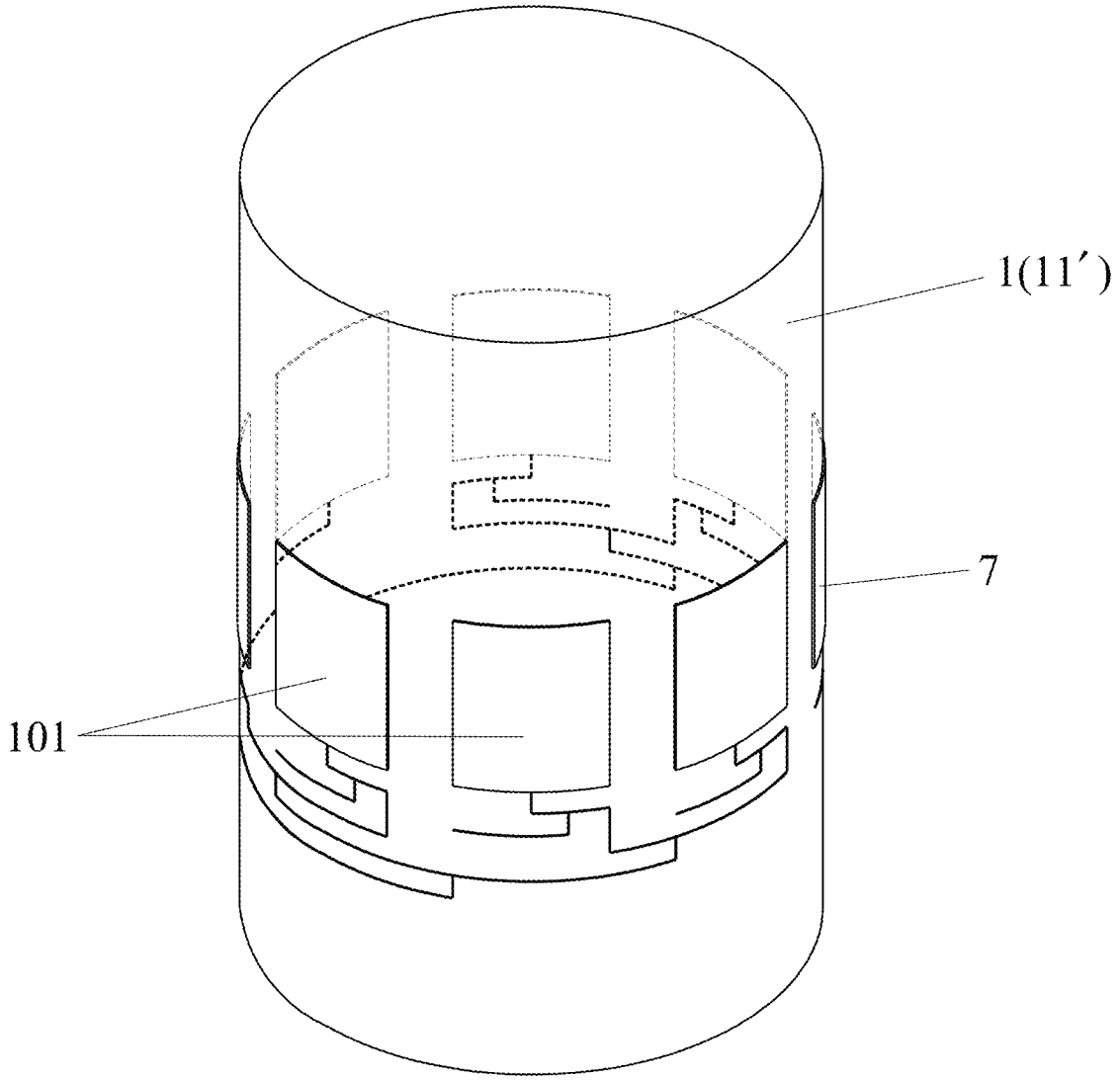
FIG. 2 is a perspective view illustrating another configuration of the conformal array antenna.
Figure 3:
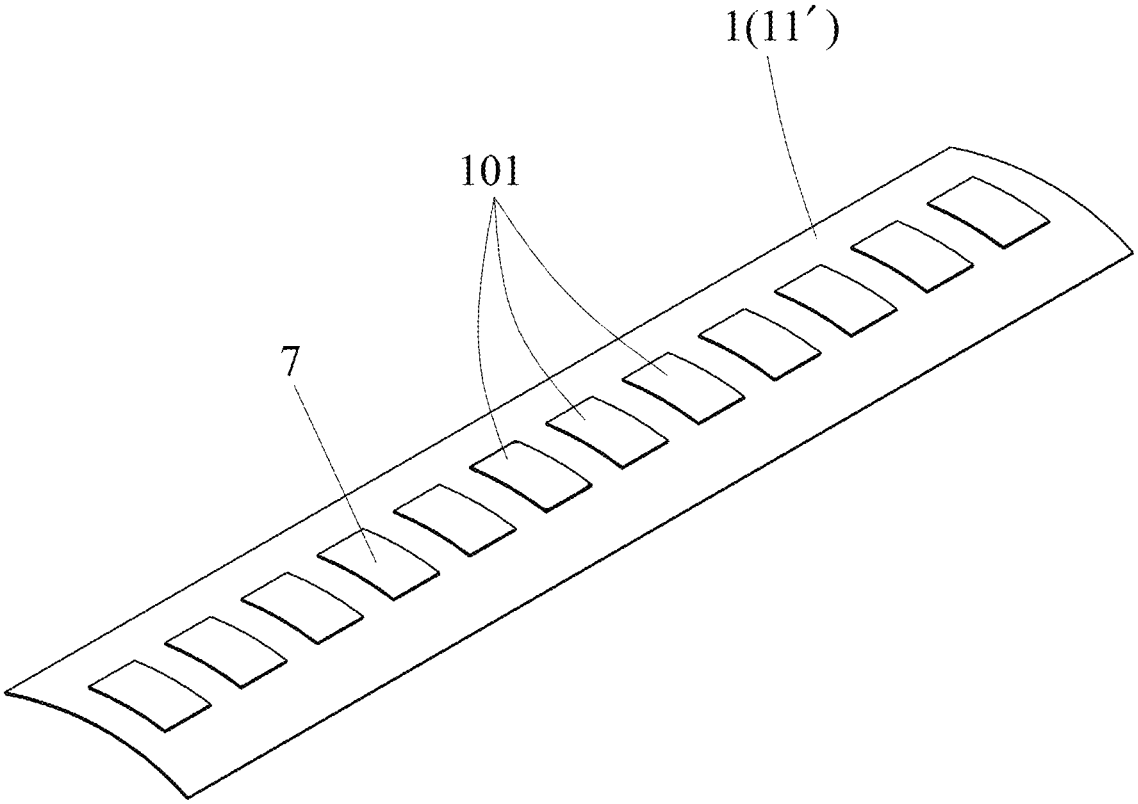
FIG. 3 is a perspective view illustrating yet another configuration of the conformal array antenna.
Figure 4:
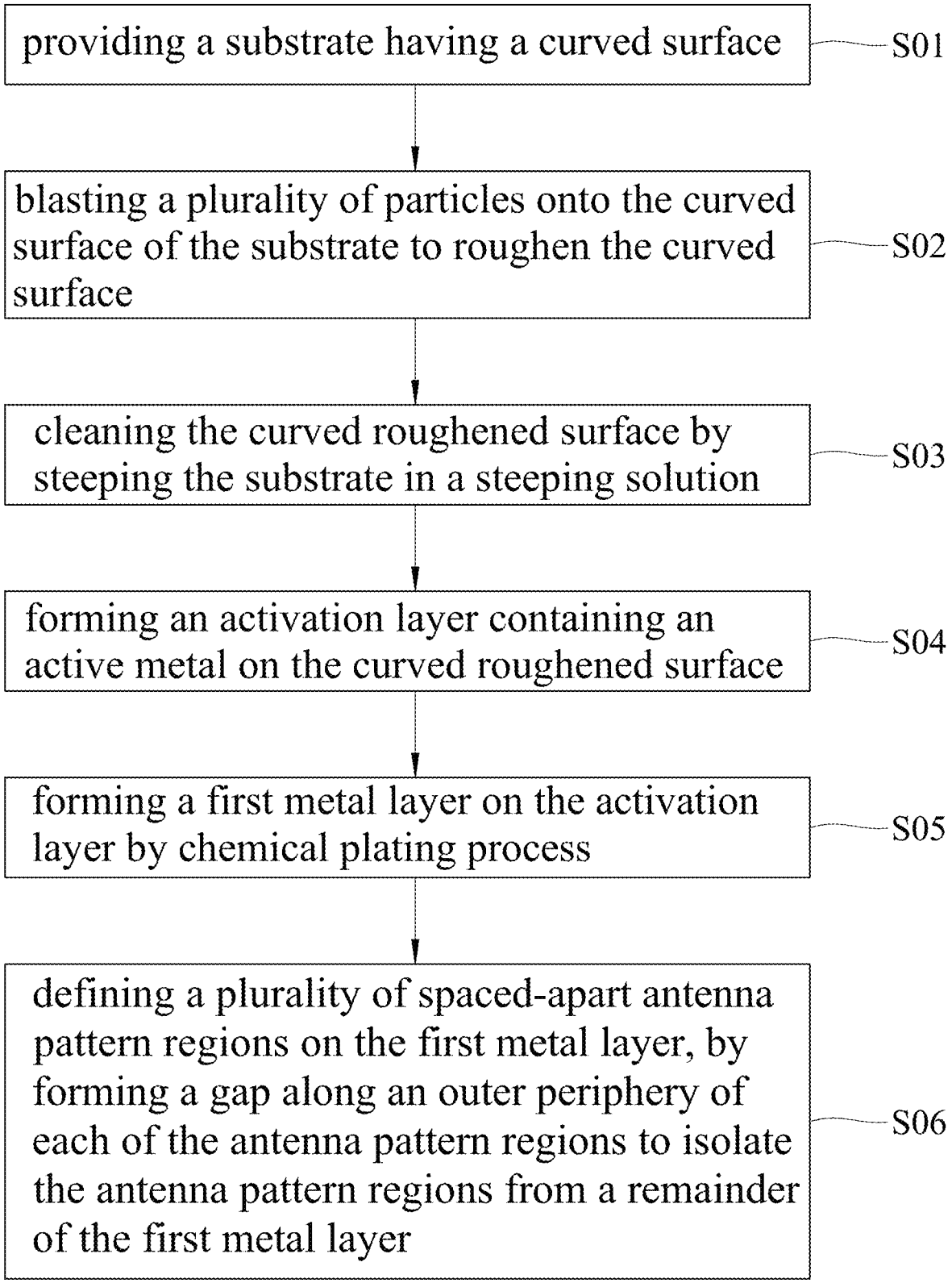
FIG. 4 is a flow chart of an embodiment of a method of manufacturing the conformal array antenna according to the disclosure.

In this embodiment, the conformal array antenna is circular dome shape. Depending on actual applications, the conformal array antenna may be hollow cylindrical in shape, as shown in FIG. 2. It should be noted that the conformal array antenna is not limited to be configured with a cylindrical or circular array of the antenna pattern regions 101 having a 360° coverage. As shown in FIG. 3, the conformal array antenna may be configured as a curved sheet with the antenna pattern regions 101 aligned in a row.

Referring to FIGS. 4-12, a method of making the conformal array antenna according to the disclosure includes the following steps.

Figure 5:
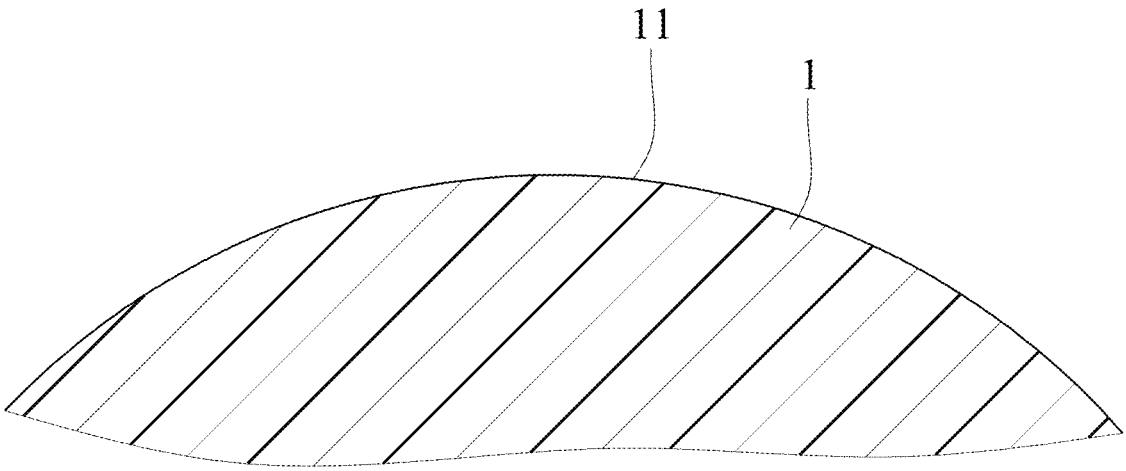
FIG. 5 is a fragmentary sectional view illustrating providing a substrate having a curved surface.

In Step S01, the substrate 1 having a curved surface 11 is provided, as shown in FIG. 5. In certain embodiments, the substrate 1 is non-conductive and is made of a plastic material. The substrate 1 may be circular dome-shaped, dome-shaped, hollow cylindrical-shaped or curved sheet-shaped. In this embodiment, the substrate 1 is made of polycarbonate (PC), and is circular dome-shaped. Alternatively, the substrate 1 may include a base made of metal, and a non-conductive coating disposed on the base and providing a non-conductive surface for the following steps.

Figure 6:
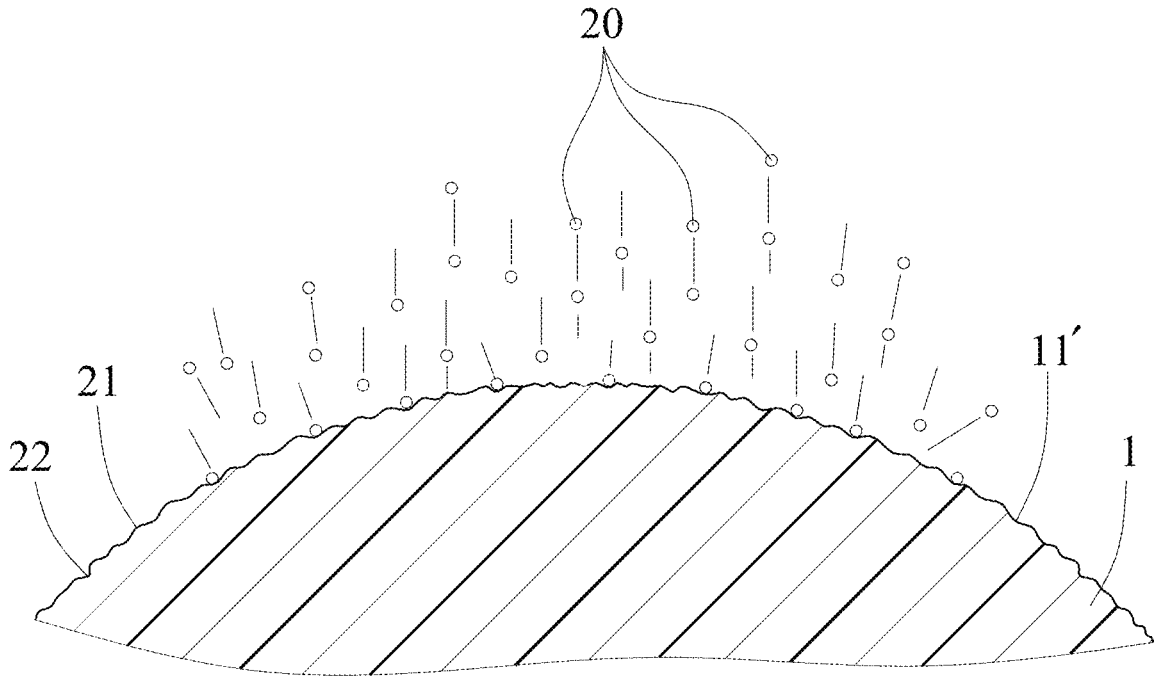
FIG. 6 is a fragmentary schematic sectional view illustrating blasting a plurality of particles onto the curved surface of the substrate to form a roughened curved surface.

In Step S02, a plurality of particles 20 are blasted onto the curved surface 11 of the substrate 1 to roughen the curved surface 11, as shown in FIG. 6. The particles 20 are selected from one of steel grits and emery sands. The particles 20 are blasted from, for example, a plurality of equi-angularly spaced apart nozzles (not shown) disposed to surround the substrate 1.

When steel grits are selected to be used as the particles 20, the blasting is conducted at a range of 30 to 150 psi at an angle ranging from 30 to 60 degrees with respect to the curved surface 11 of the substrate 1, and the steel grits have a particle size ranging from 0.18-0.43 mm. In one example, the blasting is conducted at 30 psi at an angle of 30 degrees with respect to the curved surface 11 of the substrate 1.

When emery sands are selected to be used as the particles 20, the blasting is conducted at a range of 30 to 150 psi at an angle ranging from 30 to 60 degrees with respect to the curved surface 11 of the substrate 1, and the emery sands have a particle size ranging from 125-150 μm. In one example, the blasting is conducted at 30 psi at an angle of 30 degrees with respect to the curved surface 11 of the substrate 1.

Figure 13:
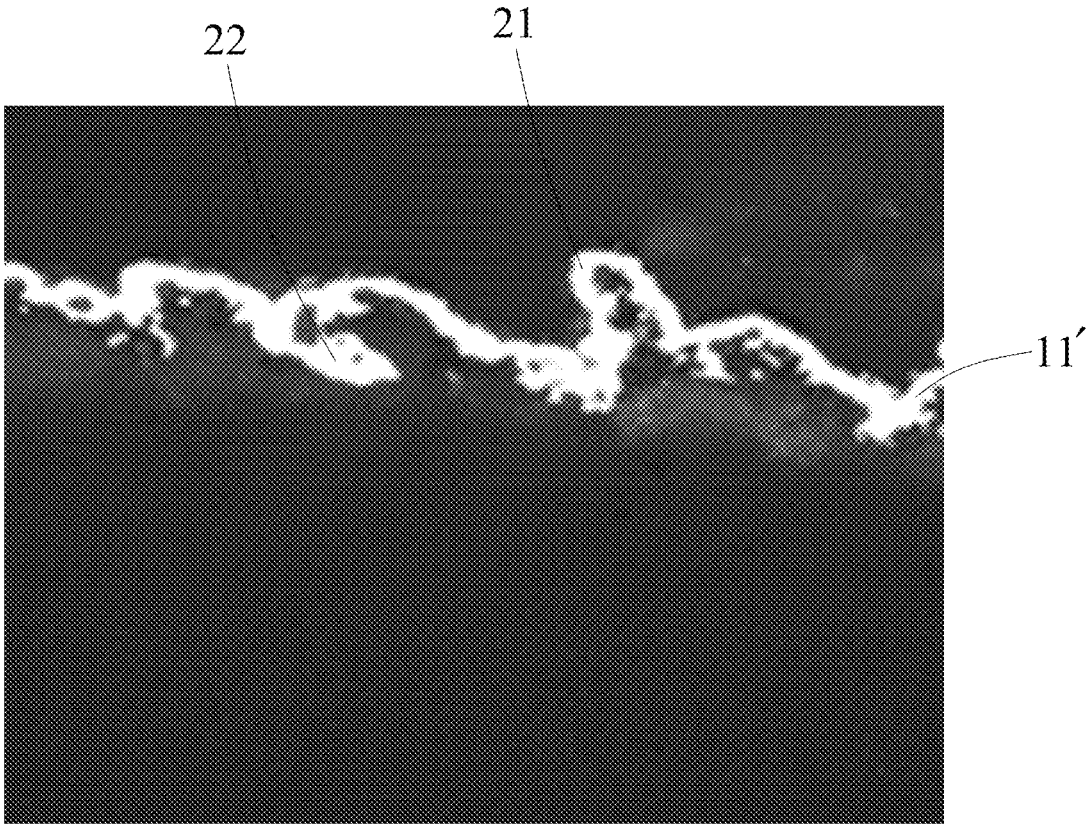
FIG. 13 is an image illustrating the roughened curved surface of the substrate of the conformal array antenna of the embodiment formed with a plurality of hooked-shaped structures.

The curved surface 11 of the substrate 1 is uniformly roughened after blasting with the particles 20 to become a roughened curved surface 11', which has a plurality of hook-shaped structures including a plurality of hooks 21 protruding from the roughened curved surface 11' and a plurality of hooked-shaped grooves 22 grooved from the roughened curved surface 11' (see FIG. 13, with a magnification of 500×). In this embodiment, the hook-shaped structures have a height from the roughened curved surface 11' ranging from 30 to 70 μm. More specifically, the roughened curved surface 11' has an arithmetical mean roughness (Ra) ranging from 2 to 8 μm, and a ten-point mean roughness (Rz) ranging from 30 to 70 μm. In certain embodiments, the curved surface 11 is roughened by, for example but not limited to, chemical etching or laser ablation.

In step S03, the roughened curved surface 11' is cleaned by steeping the substrate 1 in a steeping solution selected from one of ketone, ether, and ester for removal of an excess of the particles 20 which remain on the roughened curved surface 11' after the blasting of the particles 20 thereon. The steeping solution is selected from a group consisting of methyl ethyl ketone, 3-methyl-2-butanone, diethylene glycol monobutyl ether, and propylene glycol methyl ether acetate. In this embodiment, the steeping solution is diethylene glycol monobutyl ether.

Figure 7:
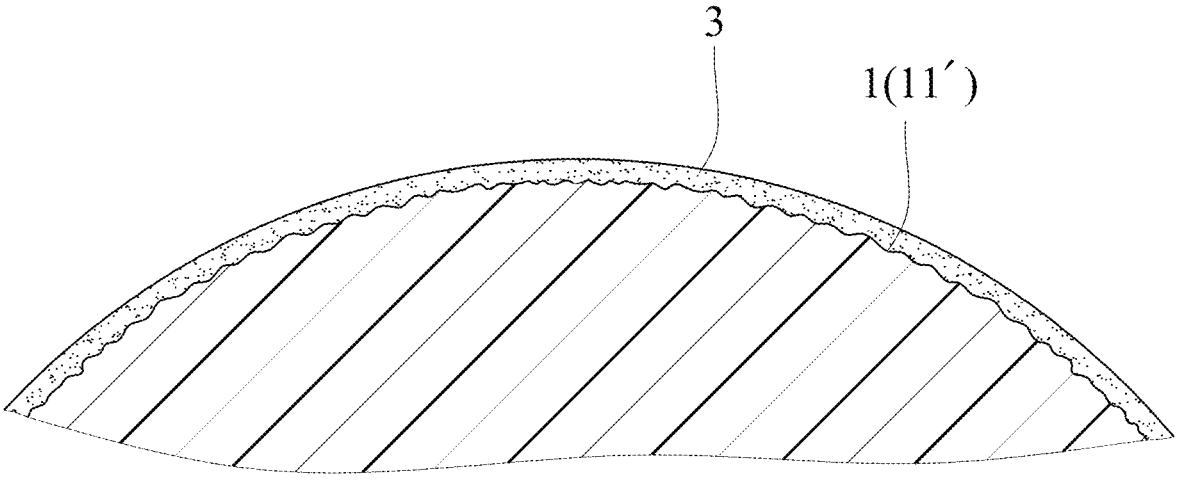
FIG. 7 is a fragmentary sectional view illustrating forming an activation layer on the roughened curved surface.

Referring to FIG. 7, in step S04, an activation layer 3 containing an active metal is formed on the roughened curved surface 11' by steeping the substrate 1 in a solution containing the active metal for a predetermined amount of time. The active metal is selected from, but not limited to, one of palladium, rhodium, platinum, silver, and the combination thereof. In this embodiment, the activation layer 3 has a thickness from 30 nm to 60 nm. Since the excess particles 20 remained on the roughened surface are removed by steeping the substrate 1 in the steeping solution, as mentioned in the previous step, entry of the active metal into the hooked-shaped grooves 22 is facilitated to thereby enhance coupling strength between the activation layer 3 and the substrate 1.

Figure 8:
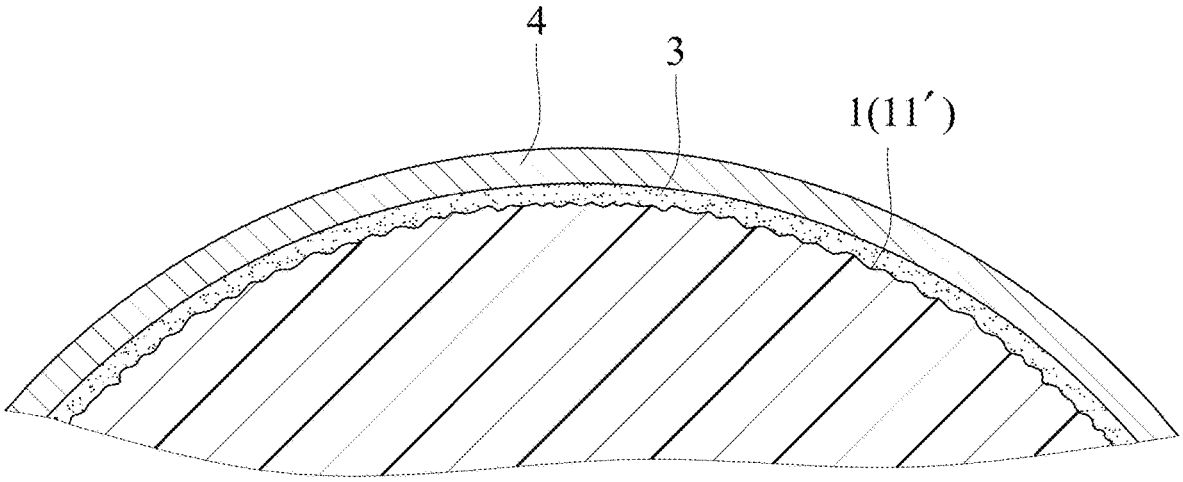
FIG. 8 is a fragmentary sectional view illustrating forming a first metal layer on the activation layer.

Referring to FIG. 8, in step S05, a first metal layer 4 is formed on the activation layer 3 by chemical plating process. The plating process is performed by steeping the substrate 1 in a chemical plating solution for a predetermined amount of time. In this embodiment, the first metal layer 4 has a thickness from 0.5 μm to 2 μm, and the metal used for forming the first metal layer 4 is nickel. In other embodiment, the metal may be copper, and is not limited thereto.

Figure 9:
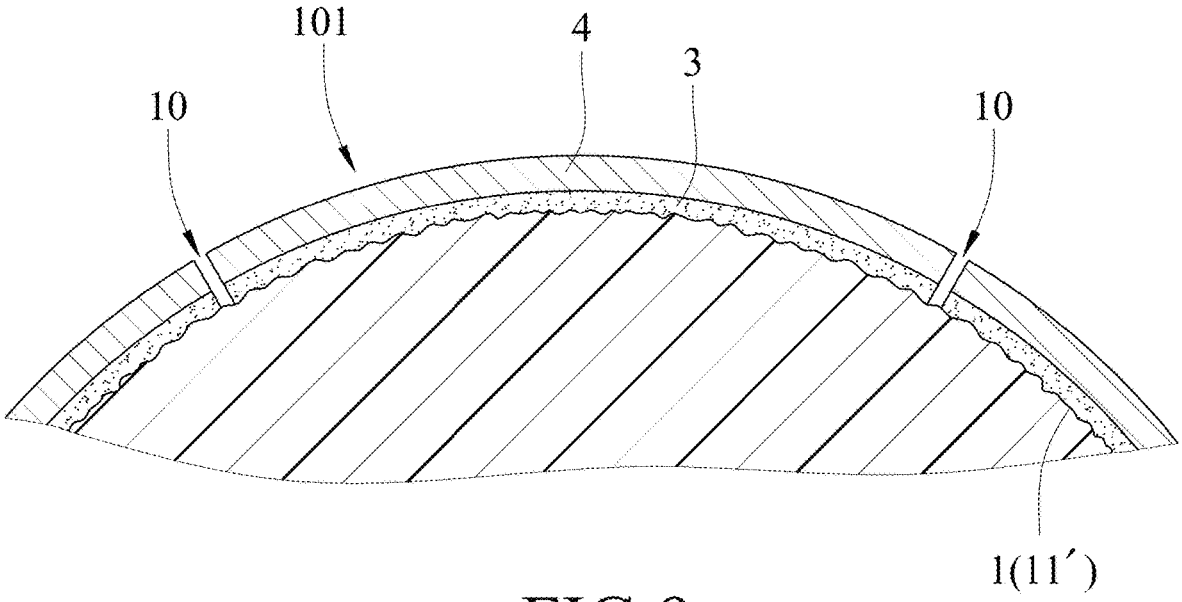
FIG. 9 is a fragmentary sectional view illustrating isolating an antenna pattern region from a non-pattern region of the first metal layer.

Referring to FIG. 9, in step S06, the antenna pattern regions 101 (only one is shown in FIG. 9) are defined on the first metal layer 4 by forming a gap 10 along an outer periphery of each of the antenna pattern regions 101 to isolate the antenna pattern regions 101 from a remainder of the first metal layer 4 (herein after referred to as a non-pattern region).

In this embodiment, the forming of the gap 10 in Step S06 is conducted by removing part of the first metal layer 4 and the activation layer 3 by laser ablation.

Figure 10:
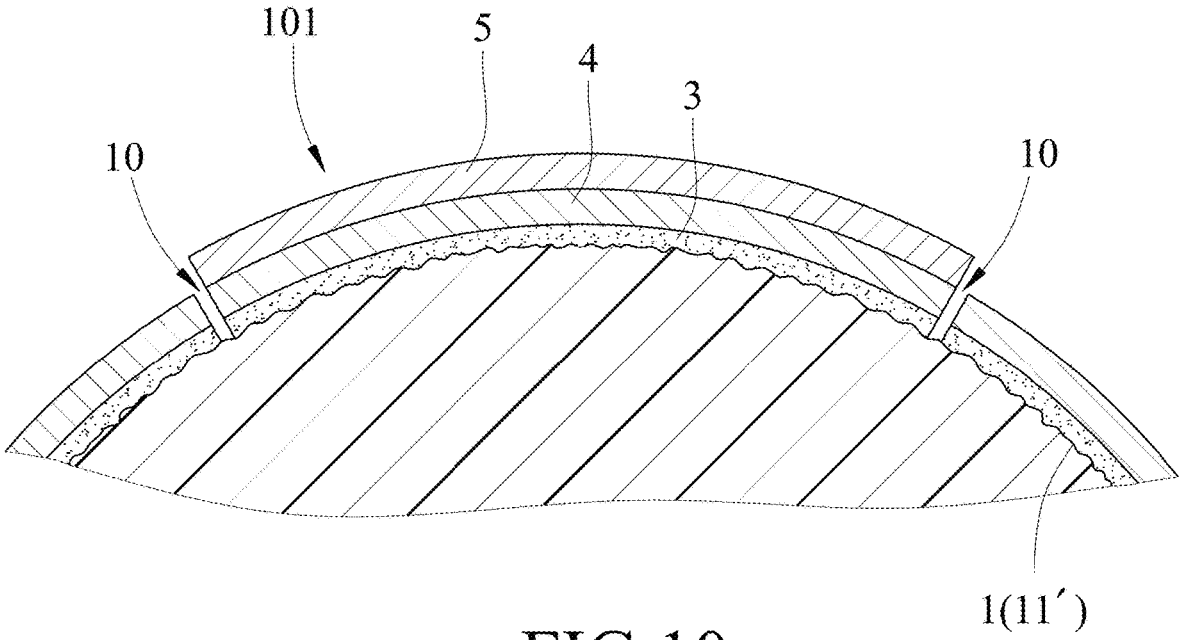
FIG. 10 is a fragmentary sectional view illustrating forming a second metal layer on the first metal layer in the antenna pattern region.

Referring to FIG. 10, after the isolation of the antenna pattern regions 101, a second metal layer 5 is formed on the first metal layer 4 in the antenna pattern regions 101 by electroplating process. In this embodiment, the second metal layer 5 is made of copper. That is, a copper-containing electroplating solution with copper electrodes is used during the electroplating process. The second metal layer 5 has a thickness from 5 μm to 30 μm in this embodiment. Since the antenna pattern regions 101 are isolated, the second metal layer 5 is formed only on the first metal layer 4 in the antenna pattern regions 101 during the electroplating process.

Figure 11:
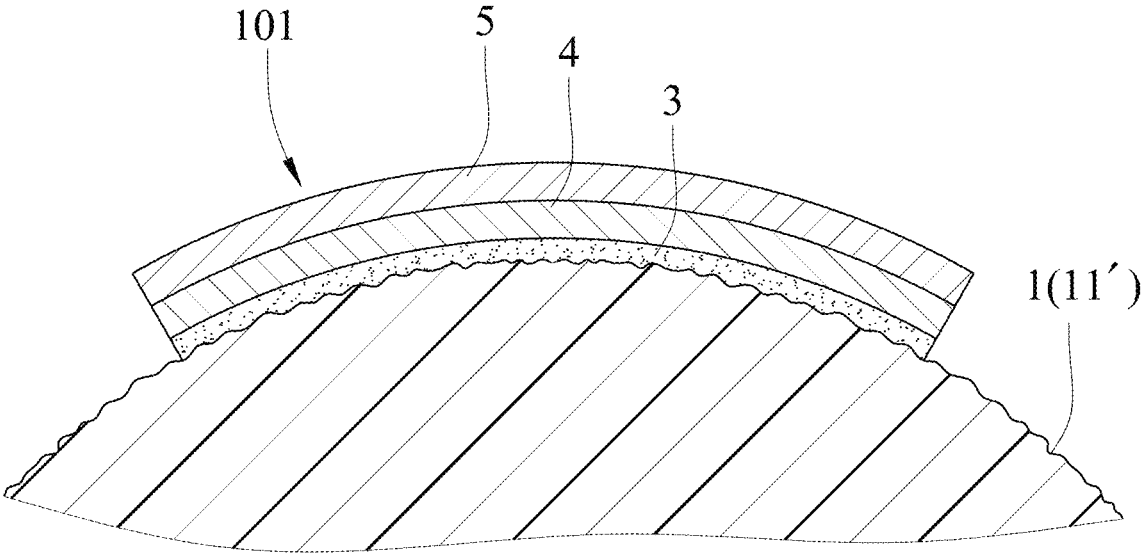
FIG. 11 is a fragmentary sectional view illustrating removing the first metal layer and the activation layer in the non-pattern region which is outside of the antenna pattern region.

Referring to FIG. 11, after formation of the second metal layer 5 is completed, the first metal layer 4 and the activation layer 3 in the non-pattern region are removed by wet etching process. In this embodiment, an entire outer surface of the substrate 1 is etched such that the first metal layer 4 and the activation layer 3 in the non-pattern region, and part of the second metal layer 5 in the antenna pattern regions 101 are removed in an efficient manner. After the wet etching process, only the activation layer 3 and the first and second metal layers 4, 5 in the antenna pattern regions 101 are remained, thereby forming a conductive circuit 7 on the substrate 1 of the conformal array antenna.

The second metal layer 5 may be thickened by electroplating process for obtaining a desired thickness of the second metal layer 5 according to actual requirement.

Figure 12:
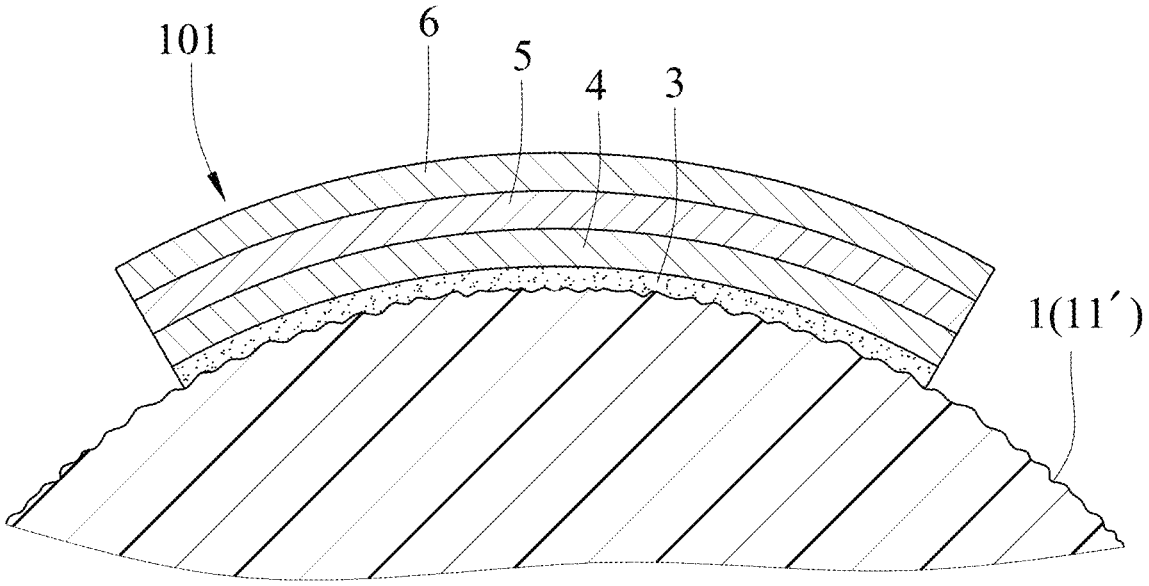
FIG. 12 is a fragmentary sectional view illustrating forming a protective metal layer on the second metal layer; and FIG. 13

Referring to FIG. 12, a protective metal layer 6 may be formed on the second metal layer 5 to prevent oxidation of the second metal layer 5. In this embodiment, the metal is used for forming the protective metal layer 6 is nickel to prevent oxidation of the copper in the second metal layer 5.

The method of making the conformal array antenna according to the disclosure has the following advantages:

1. By blasting a plurality of the particles 20 onto the curved surface 11 of the substrate 1, the entire curved surface 11 of the substrate 1 is uniformly roughened in an easy and efficient manner.

2. By steeping the substrate 1 into the steeping solution after blasting with the particles 20 thereon, the particles 20 remained on the roughened curved surface 11' can be removed in a relatively fast and effective manner, and the activation layer 3 can be firmly coupled to the roughened curved surface 11 by entry of the active metal into the hooked-shaped grooves 22.

3. By forming the gap 10, only the part of the first metal layer 4 and the activation layer 3 along the outer periphery of each of the antenna pattern regions 101 needs to be removed by laser ablation technique, and thus, operating time of a laser ablation machine and the manufacturing cost are significantly reduced in comparison with the above-mentioned conventional method of forming a patterned conductive circuit on a radar antenna. Therefore, the method of the disclosure provides a fast way to form a circuit pattern on a non-conductive substrate for making a conformal array antenna, and the method of the disclosure is suitable for substrate that is relatively large in size.

Referring to FIG. 13 in combination with FIGS. 1-3 and 12, the substrate 1 has the roughened curved surface 11' formed with the hook-shaped structures. The conductive circuit 7 is located in the antenna pattern regions 101, and includes the activation layer 3 formed on the roughened curved surface 11', the first metal layer 4 formed on the activation layer 3, the second metal layer 5 formed on the first metal layer 4, and the protective metal layer 6 formed on the second metal layer 5.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A method of making a conformal array antenna comprising:

providing a substrate having a non-conductive curved surface;

blasting a plurality of particles onto the curved surface of the substrate to roughen the curved surface;

forming an activation layer containing an active metal on the roughened curved surface;

forming a first metal layer on the activation layer by chemical plating process; and defining a plurality of spaced-apart antenna pattern regions on the first metal layer, by forming a gap along an outer periphery of each of the antenna pattern regions to isolate the antenna pattern regions from a remainder of the first metal layer.

2. The method of claim 1, wherein the substrate is circular dome-shaped or dome-shaped.

3. The method of claim 1, further comprising forming a second metal layer on the first metal layer in the antenna pattern regions by electroplating process.

4. The method of claim 1, wherein the roughened curved surface has a plurality of hook-shaped structures including a plurality of hooks protruding from the blasted surface and a plurality of hooked-shaped grooves grooved from the blasted surface.

5. The method of claim 1, wherein the roughened curved surface has an arithmetical mean roughness (Ra) ranging from 2 to 8 μm, and a ten-point mean roughness (Rz) ranging from 30 to 70 μm.

6. The method of claim 1, wherein the particles are selected from one of steel grits and emery sands.

7. The method of claim 6, wherein the particles are steel grits having a particle size ranging from 0.18-0.43 mm.

8. The method of claim 7, wherein the blasting of the particles onto the substrate is conducted at 22 psi at an angle of 90 degrees with respect to the surface of the substrate.

9. The method of claim 6, wherein the particles are emery sands having a particle size ranging from 125-150 μm.

10. The method of claim 9, wherein the blasting of the particles onto the substrate is conducted at 26 psi at an angle of 45 degrees with respect to the curved surface of the substrate.

11. The method of claim 1, further comprising cleaning the roughened curved surface by steeping the substrate in a steeping solution selected from one of ketone, ether, and ester for removal of an excess of the particles which remain on the roughened surface after the blasting of the particles thereonto.

12. The method of claim 11, wherein the steeping solution is selected from a group consisting of methyl ethyl ketone, 3-methyl-2-butanone, diethylene glycol monobutyl ether, and propylene glycol methyl ether acetate.

13. The method of claim 1, wherein the forming of the gap is conducted by laser ablation.

14. A method of making a conformal array antenna comprising:

providing a substrate having a non-conductive curved surface;

roughening the curved surface;

forming an activation layer containing an active metal on the roughened curved surface;

forming a first metal layer on the activation layer by chemical plating process; and defining a plurality of spaced-apart and substantially evenly distributed antenna pattern regions on the first metal layer, by forming a gap along an outer periphery of each of the antenna pattern regions to isolate the antenna pattern regions from a remainder of the first metal layer.

* * * * *